United States Patent [19]

Steele, Jr.

[11] Patent Number: 4,759,546

[45] Date of Patent: Jul. 26, 1988

[54] HAND-HELD RACKETS FOR GAMES

[76] Inventor: John R. Steele, Jr., 11370 Old Halls Ferry Rd., Florissant, Mo. 63033

[21] Appl. No.: 847,700

[22] Filed: Apr. 3, 1986

[51] Int. Cl.[4] ..... A63B 49/08

[52] U.S. Cl. ..... 273/73 J; 273/75; 273/29 A

[58] Field of Search ..... 273/73 R, 73 J, 75, 273/81.3, 80 C, 67 DA, 72 R

[56] References Cited

U.S. PATENT DOCUMENTS

| | | | |
|---|---|---|---|
| 3,545,755 | 12/1970 | Owada | 273/73 J |
| 4,038,719 | 8/1977 | Bennett | 273/81.3 X |
| 4,183,528 | 1/1980 | An | 273/75 |
| 4,659,080 | 4/1987 | Stoller | 273/75 |

FOREIGN PATENT DOCUMENTS

| | | | |
|---|---|---|---|
| 3312927 | 10/1984 | Fed. Rep. of Germany | 273/75 |
| 170717 | 11/1921 | United Kingdom | 273/73 J |

*Primary Examiner*—Richard C. Pinkham
*Assistant Examiner*—William E. Stoll
*Attorney, Agent, or Firm*—Haverstock, Garrett & Roberts

[57] ABSTRACT

An improved implement for use in playing the game of tennis and the like wherein the handle assembly associated therewith is sloped or offset in one or more planes relative to the longitudinal equilibrium axis of the implement to facilitate and enhance the gripping and manipulation of the implement during the course of play and enable a user to achieve a more comfortable range or wrist movement without sacrificing implement position and without overloading or overstressing the wrist, forearm and/or elbow of the user. The present handle assembly includes a grip portion having a longitudinal axis which intersects the axis of longitudinal equilibrium of the implement at an angle of approximately 13.5° (±4°) in the plane of the planar surface of the implement head assembly. The present handle assembly may likewise include an additional angular offset provided in still another plane wherein the longitudinal axis of the grip portion also additionally intersects the axis of longitudinal equilibrium of the implement at an angle of approximately 8° (±4°) in a plane perpendicular to the plane of the planar surface of the implement head assembly. The handle grip portion may also include a plurality of bulbous projections circumferentially spaced about the periphery thereof which enable a user to achieve a more comfortable grasp and more easily make rapid grip adjustments during the course of play to better meet the requirements of the specific type of stroke required.

25 Claims, 8 Drawing Sheets

HAND-HELD RACKETS FOR GAMES

The present invention relates to improved rackets for tennis and the like and, more particularly, to several embodiments of a hand-held racket wherein the racket handle is sloped or offset in one or more planes relative to the longitudinal equilibrium axis of the implement to facilitate and enhance the gripping and manipulation of the racket during the course of play and to provide for greater racket control and positioning while reducing the potential for injury to one's wrist, forearm and/or elbow. Use of the present racket devices enables one to achieve a more comfortable range of wrist movement and a more comfortable range of grasp on the racket handle itself without sacrificing racket position and without overloading or overstressing the wrist, hand, forearm and/or elbow of the user. Although the racket implements discussed and illustrated herein are specifically designed for use in playing the game of tennis, it is also recognized that the present racket handles are likewise adaptable for use on other racket implements such as rackets used in playing the games of squash, racquetball, paddleball, ping pong and the like.

BACKGROUND OF THE INVENTION

In recent years it has been increasingly recognized that the conventional straight-shaft design for hand-held rackets used in the game of tennis and the like, as well as the required techniques for using such rackets, is not optimum for either generation of maximum power or for achievement of maximum accuracy in play because the conventional straight-shafted racket does not easily enable a user to constantly make rapid grip adjustments necessary during the course of play. More importantly, it has been recognized that conventional racket designs and play techniques cause or induce physical injury by failing to recognize and compensate for the physiological limitations associated with the movement of a user's wrist, forearm and elbow. Such physical injury and problems include sprain of the ligaments of the small finger (ulnar) side of the wrist as well as the ligaments of the back of the wrist, both of which may be induced by a racket design that promotes a laid-back wrist position in a conventional stroke or swing, a position which affords little shock absorption to protect the ligaments in question. Further, lateral tennis elbow or elbow tendonitis occasioned by overloading the forearm-wrist extensor muscle is induced by a conventional racket design which promotes a faulty or incorrect stroke wherein the elbow leads the racket head in a forearm stroke or in "punching" backhand strokes. Medial tennis elbow is sometimes experienced which is occasioned by overloading the forearm muscle induced by rolling the forearm over in a stroke attempting to induce and/or neutralize the spin associated with the oncoming ball or by utilizing a consistently late forehand stroke which requires excessive wrist snap. Similarly, overhead or service strokes entailing substantial acceleration of the racket head from the initial or starting position (racket head behind the user's shoulders) tend to induce excessive wrist snap and consequential overloading or overstressing of such wrist muscles. Still further, shoulder tendonitis or irritation of the shoulder rotator cuff is sometimes occasioned by overloading or overstressing such muscles in a stroke wherein the arm is at an angle of 90° or more to the body trunk as in a service stroke, a stroke above shoulder height or a high follow-through stroke. All of such overloading/overstressing of the wrist, forearm, elbow and shoulder inducing the previously mentioned and other types of muscle and tendon strain is magnified when a racket stroke entails a wrist or elbow positioning near the limits of its range of substantially unstressed or comfortable movement.

It is well known that players of the games of tennis, squash, racquetball, paddleball, ping pong and the like constantly make grip changes and adjustments during the course of play in preparation of hitting the oncoming ball depending upon the location, speed and type of spin on the ball as well as the player's position relative to the ball and many other factors. A player's grip may likewise vary because of differences in court surfaces causing the ball to bounce higher, lower, slower or faster. This is particularly true in the game of tennis where the playing surface may consist of soft clay, hard clay, grass, astroturf, wood or other surfaces. One's grip may also vary because of the particular type of stroke being used by the player, for example, a stroke to put topspin or backspin on the ball or to achieve a chopping or slicing action. Whatever the game, it is well acknowledged that the grip of the racket is the foundation of many, if not all, shots particularly with respect to the game of tennis. How one holds the racket will influence the angle of the racket face, where one meets the ball in relationship to one's body position, and what happens at the moment of impact of the ball with the racket.

One problem associated with the conventional straight-shafted racket design is that such a design does not always allow for rapid grip adjustments during the course of play within the unstressed or comfortable range of movement of the wrist, elbow and shoulder as well as within one's comfortable range of grasp of the implement handle. For example, in the game of tennis, three basic hand grips are used, namely, the Continental grip, the Western grip and the Eastern grip, each grip having particular advantages and disadvantages depending upon the type and style of play. The Continental grip is the same for both forehand and backhand shots and is advantageous for hitting balls below waist level. Use of the Continental grip is less desirable when hitting balls above chest level because it is extremely difficult to gain good racket face control and it requires an exceptionally strong wrist and excellent timing. Use of the Continental grip in this situation may induce injury to the wrist.

The Western grip closes the face of the racket and is used for exaggerated topspin and groundstrokes where contact with the ball is made in front of rather than alongside the body. Since the hand is basically under the racket to close the racket face, it is extremely awkward to rotate the wrist sufficiently to open the racket face for low ball shots and, when attemped, may cause injury. Furthermore, many players who use the Western grip for forehand shots keep the same grip for backhand shots, hitting the ball with the same face of the racket. This technique puts extreme tension on the elbow and arm and can cause tennis elbow. An alternative Western backhand stroke is to lay the thumb on the straight-shafted handle so that it is pointing directly up the handle as compared to across and around the handle. In this situation, the player must choose to go "over" or "under" for a grip change which still necessitates a high elbow on the stroke and causes difficulty with hitting low balls.

Use of the Eastern grip, which is often referred to as the "shake hands" grip, calls for a definite change of grip between the forehand and backhand positions. The change of grip between backhand and forehand strokes usually requires an approximately one-eighth (⅛) turn grip adjustment(s) or approximately 45° of rotation on the racket handle.

Variations and combinations of the above-identified grips as well as other known grips are likewise used such as the Australian grip, Semi-Western grip and two-handed grips, all of which grips place a certain amount of stress and/or strain on the wrist, elbow and/or shoulder when attempting to make certain shots because of the awkwardness of the particular grip used or the unavailability of nuances of racket work required. For these reasons, tennis players constantly make grip adjustments not only to accommodate the location, speed and/or spin associated with the oncoming ball but also to reduce the probability of overstressing or overloading the wrist, elbow and/or shoulder. A conventional straight-shafted racket design does not afford easy transition from one grip to another.

Furthermore, in the game of tennis as well as squash, racquetball, paddleball, ping pong and the like, the various types of strokes include backhand, forehand, overhead and serve, all with or without slicing or chopping action. Two basic categories of wrist strokes or a combination thereof are generally used during the course of play, the first category being the snap-wrist stroke and the second category being the locked-wrist stroke. As the name applies, the snap-wrist stroke or swing entails forward motion of the arm in a plane to contact the ball with the racket and simultaneous forward snapping, rolling or acceleration of the wrist about an axis in a plane parallel to the plane of the palm of the hand, the snap or roll occurring through and past the range of comfortable wrist pivoting and through an arc of normally up to about 120° . In the locked-wrist stroke or swing, the wrist is locked and the arm swung in a forward and upward arc while the conventional racket is ideally maintained in a "heads-up" position wherein the racket head is higher than the racket handle, such racket positioning requiring an upward pivoting of the user's hand about an axis of the wrist in a plane perpendicular to the plane of the palm of the hand towards the upper limits of comfortable wrist pivoting in this direction, namely, through an angle of about 40°. Variations or combinations of these basic stroke categories are encountered when topspin, backspin, chop or slicing action is applied to the ball on impact by a stroke entailing extreme pivoting movement of the wrist about the axis perpendicular to the palm of the hand commonly called "laying back of the wrist" and/or by rolling of the forearm about its longitudinal axis. This is true regardless of the particular grip being used. In all of these strokes, the wrist, forearm and elbow are often driven or forced through, or required to assume at least a momentary position beyond the normal, unstressed or comfortable range of movement about their respective pivot axes. Likewise, in all of these strokes, conventional racket designs and playing techniques can induce physical injury not only because they fail to take into account the natural range of normal, unstressed or comfortable movement of the wrist, forearm and elbow, but, more importantly, because use and play of such rackets also promotes and fosters the use of either a strained wrist position to attain the desired racket position in a locked-wrist stroke or the use of a strained wrist initial and final position to obtain the desired racket position in a snap-wrist stroke. In both of these situations, the muscles and ligaments of the wrist, forearm, elbow and even the shoulder are easily overloaded by the force exerted to accomplish the particular stroke, the racket weight and/or its inertia. It is likewise true that such strained wrist positions interfere with comfortable development of maximum power and consistent accuracy.

A number of prior art patents have recognized certain of these problems and shortcomings by suggesting modifications to the conventional straight-shafted racket design. Such modified racket designs are disclosed in U.S. Pat. Nos. 3,545,755; 4,147,348; 4,183,528; 4,360,201; 4,402,508; and 4,478,416. In each of these patents a racket design is disclosed wherein a racket handle or a racket head is offset from its conventional straight-shafted position to enhance power, accuracy or to reduce possible injury to the user such as tennis elbow or the like. However, each of these prior art designs have failed to produce a commercially viable or acceptable alternative to conventional straight-shafted racket designs because such modified designs were either (1) not satisfactorily comfortable or effective for use with all of the various stroke types or positions normally employed in a hand-held racket type game or (2) such modified designs were not convenient or conducive to allowing a user to easily shift from one grip of the racket handle to another to achieve maximum performance, power, accuracy and comfort during the course of play.

SUMMARY OF THE INVENTION

The present invention overcomes the disadvantages and shortcomings of the prior art by providing an improved racket for use in tennis and the like, the racket comprising a racket head or blade having a generally planar surface or racket face adapted to strike a ball, a throat portion attached to the lower end of the racket head, and a handle portion attached to the lower end of the racket throat. Of particular significance in the present invention is the provision of a racket handle having a longitudinal axis which intersects the axis of longitudinal equilibrium of the implement at an angle of about 13.5° (±4°) in the plane of the racket head. Of further significance is the provision of the racket handle further including a grip portion about which the user's hand is adapted to be comfortably positioned in at least two positions about the periphery thereof, the center point of the handle grip portion or grip center coinciding substantially with the intersection of the equilibrium axis of the racket and the longitudinal axis of the handle. The grip portion of the handle is specifically designed to facilitate movement of the racket handle in one's hand, particularly rotational movement, to easily effect grip adjustments and changes. In an alternate embodiment of the present invention, the racket handle is connected to the racket throat such that the longitudinal axis thereof is additionally offset with respect to the axis of equilibrium of the racket at an angle of about 8° (±4°) in a plane perpendicular to the racket head. Either embodiment of the present invention may further include two or more bulbous projections on the grip portion of racket handle that not only provide additional ease and comfort in gripping the racket handle during the various positions of use but also aid in locating by feel the four basic rotational positions through which a racket handle is normally rotated during the course of play.

It is therefore a principal object of the present invention to provide a hand-held racket usable for tennis, squash, racquetball, paddleball, ping pong and the like which facilitates and enhances the gripping and manipulation of the racket during the course of play.

Another object is to provide an improved racket which facilitates greater racket control and positioning during play while reducing the potential for injury to one's wrist, forearm and elbow.

Another object is to provide an improved racket which avoids the disadvantages associated with the uses of prior art rackets, particularly those disadvantages associated with the use of conventional straight-shafted rackets.

Another object is to provide an improved racket that is convenient to be repositioned during play to better meet the requirements of the specific type of stroke required.

Another object is to provide an improved racket for tennis and the like which facilitates the generation of power and the achievement of maximum consistent accuracy during the course of play.

Another object is to provide an improved racket for tennis and the like wherein the racket design minimizes potential for physical injury induced by repetitive use and faulty technique.

Another object is to provide an improved racket which enables a user to achieve a more comfortable range of wrist movement without sacrificing racket position and without overloading or overstressing the wrist, forearm and/or elbow.

Another object is to provide an improved racket which can be economically produced for commercial use.

Another object is to teach the construction of a racket wherein the racket handle is sloped or offset in one or more planes relative to the plane of the racket head.

Another object is to provide an improved racket having a sloped or offset handle convenient to be grasped in different rotational positions according to the various basic stroke types such as high and low forehand and high and low backhand strokes.

Another object is to provide an improved racket having a handle adapted to be grasped at a plurality of rotational grip positions identifiable by feel.

Another object is to provide an improved racket which enables a user to easily make rapid grip adjustments during the course of play.

Another object is to provide an improved racket which enables a user to make a greater number of grip adjustments while using only one hand.

BRIEF DESCRIPTION OF THE DRAWINGS

These and other objects and advantages of the present invention will become apparent to those skilled in the art after considering the following detailed specification which discloses several embodiments of the present invention in conjunction with the accompanying drawings, wherein.

DETAILED DESCRIPTION OF THE INVENTION

Figure 1:
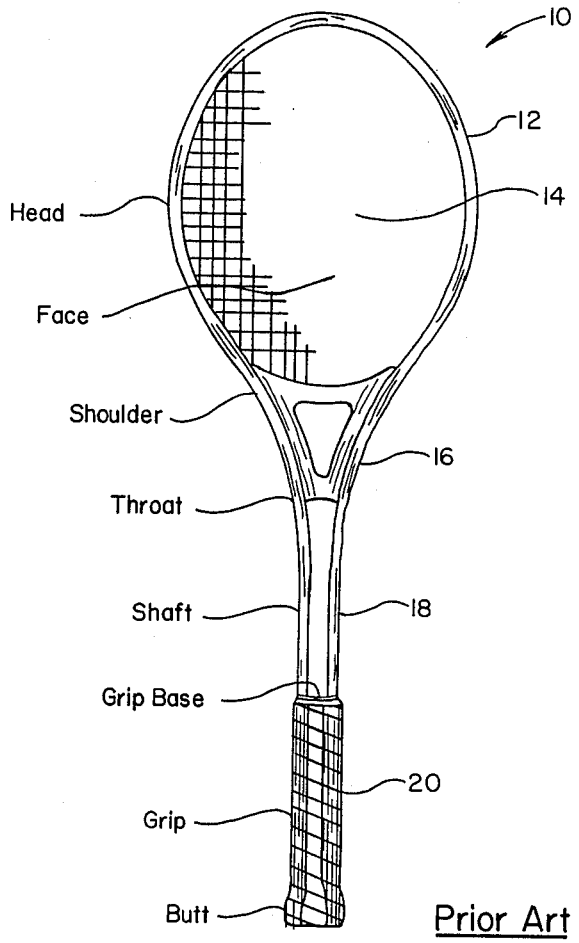
Prior Art Fig. 1
FIG. 1 is a plan view of a conventional straight-shafted tennis racket.
Figure 2:
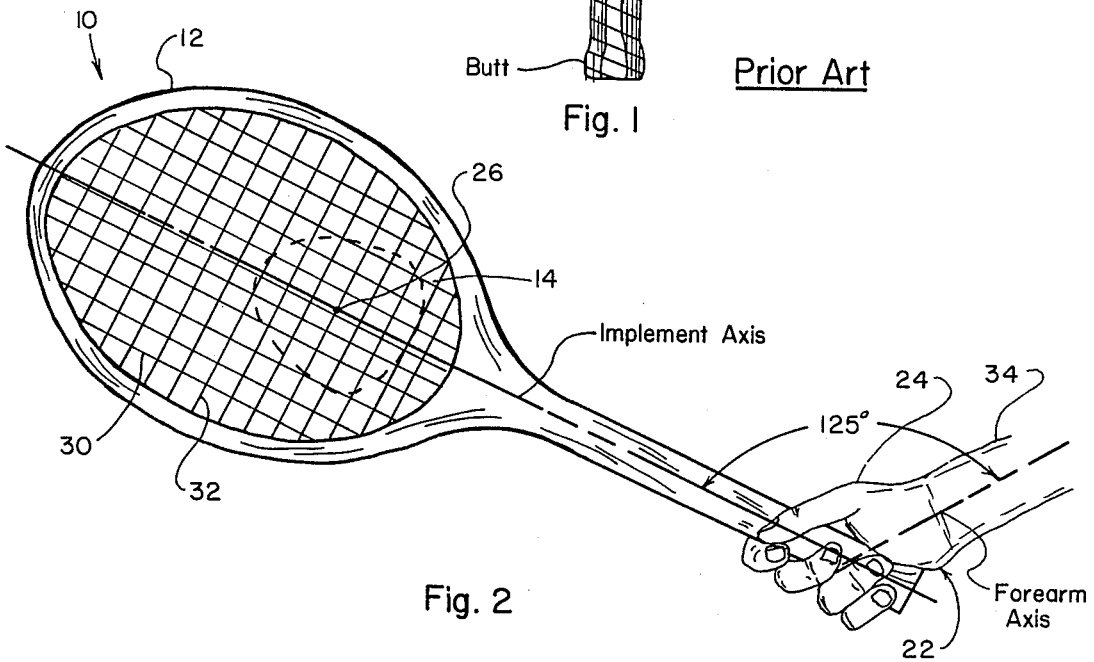
Fig. 2 Prior Art
FIG. 2 is a plan view of a conventional straight-shafted tennis racket shown grasped by a user in the "heads-up" position.

Referring to the drawings more particularly by reference numerals wherein like numerals refer to like parts, the number 10 in FIGS. 1 and 2 illustrates a conventional straight-shafted tennis racket which includes a racket head 12, a racket face or stringing surface 14, a throat portion 16, a straight shaft 18 connected to the throat portion 16, and a grip 20 mounted at the lower end of the shaft 18 for gripping of the racket 10 by a user. The racket face or stringing surface 14 is made up of vertical and horizontal courses of stringing 30 and 32 (FIG. 2). The conventional straight-shafted tennis racket 10 is shown in FIG. 2 grasped by a hand 22 of a user in what is sometimes called a "heads-up" position wherein the racket head 12 is maintained in a position higher than the user's hand 22, as in a forehand stroke at or above waist level. To achieve such an orientation of the racket head 12 for a relatively low stroke, it is necessary that the user's wrist 24 be pivoted upwardly about an axis in a plane which is perpendicular to the plane of the palm of the user's hand 22, to an extent necessary for the racket head 12 to contact a ball as near as possible to the "sweet spot" 26. In this regard, all tennis manuals and tennis coaches recommend that the "heads-up" orientation of the racket head be maintained and used on most, if not all, tennis shots since this orientation improves the relative position between the trajectory of the oncoming ball and the "sweet spot" of the racket at the moment of impact. The "sweet spot" of the racket is defined as that zone of the stringing surface within which it is best for the ball to impact and, in conventional racket design, the "sweet spot" 26 may be considered to be an oval or ellipical area located as shown in dotted outline form in FIG. 2. Contact with the ball outside this zone may cause torsional stresses on the arm and wrist due to the moments created and likewise reduces the accuracy and efficiency of the stroke. In addition, when using a "heads-up" orientation, the holding angle, that is, the angle between the equilibrium axis of the racket and the forearm axis of the user holding the racket, is sufficiently reduced (low holding angle) such that the racket is maintained in a close-in position relative to the body thereby allowing maximum utilization of the muscles of the arm for accuracy. It should be noted that in the case of a conventional straight-shafted racket, the holding angle and the gripping angle are identical, the grip angle being defined as the angle between the forearm axis of the user holding the racket and the longitudinal axis of the racket handle. This is not true with respect to the present racket assemblies as will be hereinafter explained.

Figure 4:
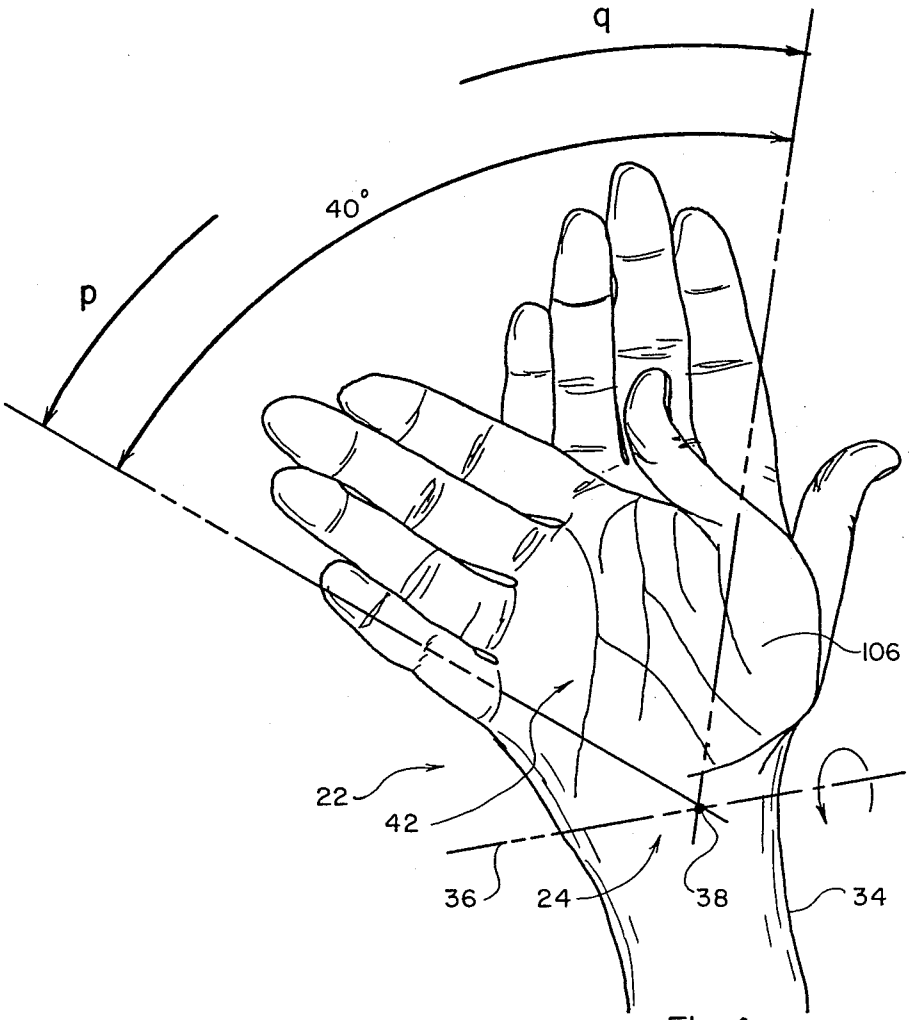
FIG. 4 is an illustration of a user's hand illustrating the normal or comfortable limits of wrist rotation about an axis in a plane perpendicular to the plane of the palm of the hand.
Figure 3:
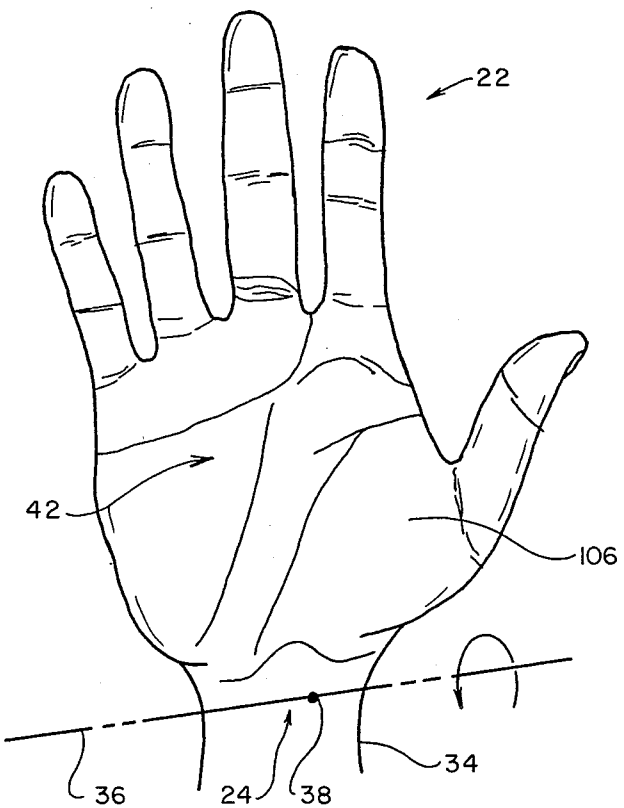
FIG. 3 is an illustration of a user's hand indicating the two axes of wrist rotation.
Figure 5:
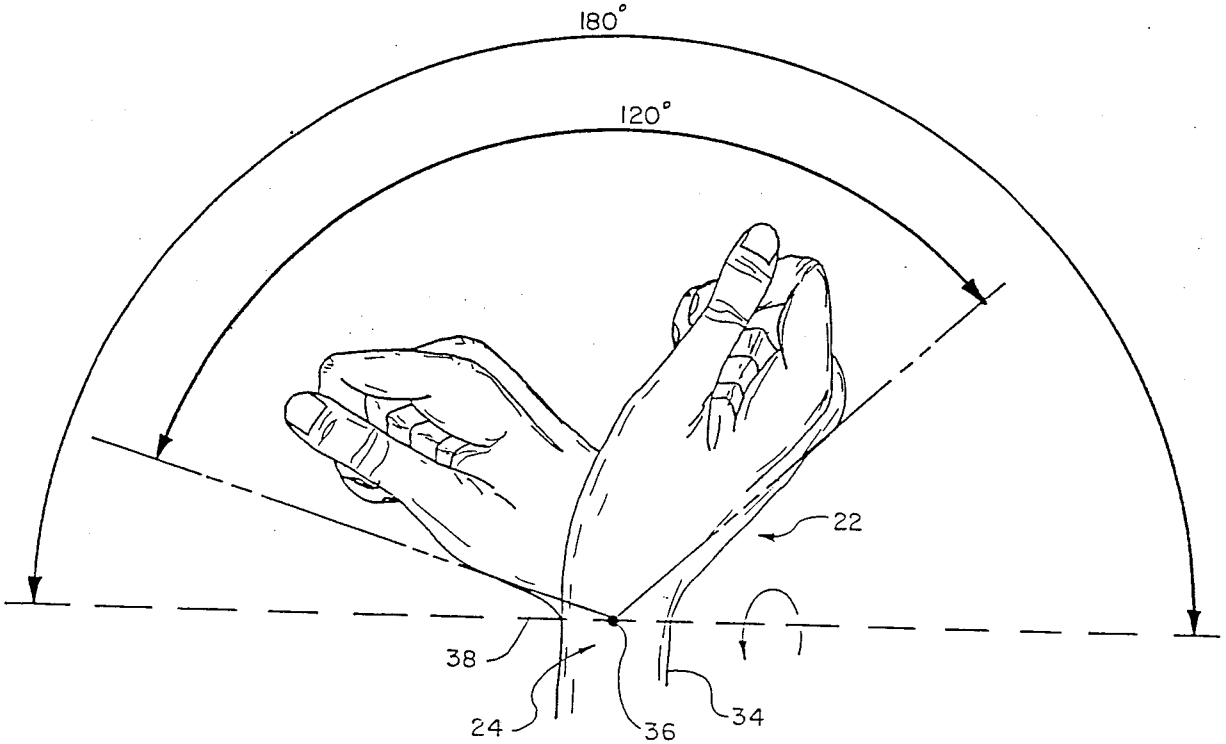
FIG. 5 is an illustration of user's hand illustrating the normal or comfortable limits of wrist rotation about an axis in a plane parallel to the plane of the palm of the hand.

Referring to FIG. 3, a normal human hand 22 is connected to the forearm 34 for pivotal movement about the major and minor axes 36 and 38 respectively of the wrist 24. The major axis 36 is defined as that axis of pivotal movement of the hand 22 about the wrist 24 lying in the plane parallel to the plane of the palm 42 of the hand. The minor axis 38 is defined as that axis of pivotal movement of the hand 22 about the wrist 24 lying in a plane perpendicular to the plane of the palm 42 of the hand. The extent of pivotal movement of the hand 22 about the minor axis 38 varies from individual to individual but may be generally considered to be in the range of about 40° as shown in FIG. 4. In FIG. 4, pivotable wrist rotation about the minor axis 38 is indicated in both the up and down direction by use of the direction arrows "p" and "q". It is this type of pivotal wrist movement that is utilized in a locked-wrist category of tennis stroke including a "heads-up" racket orientation (low holding angle) as often used for forehand and backhand strokes wherein the racket head is below chest level. The low holding angle range is defined as being in the range from about 95° to about 135° (see FIG. 11). The extent of pivotal movement of the hand 22 about the major axis 36 likewise varies from individual to individual but may be generally considered to be comfortable in the range of about 120° to 180° as shown in FIG. 5. It is this type of pivotal wrist movement that is utilized in a snap-wrist category of tennis stroke, as often employed in both relatively high forehand and backhand strokes wherein the racket head is at chest level or higher, or in overhead or service type strokes. It is also recognized that a stroke combining both lock-wrist and snap-wrist type motions may likewise be employed, with or without forearm roll, for imparting topspin, backspin, slicing or chopping action to the ball. This will usually occur when a user is holding the racket in the medium holding angle range which is defined as being in the range from about 135° to about 160° (see FIG. 15).

Wrist action therefore plays an important role in all hand-held racket type games. If the wrist is locked in what is sometimes called and often recommended, the "laid-back" position through a particular type stroke, a controlled shot is produced. When such wrist action is used to generate racket head velocity through a particular stroke, a coupling effect is produced which accentuates power. If the wrist is worked in an up and down direction during ball impact, excessive spin can be imparted to the ball. However, if the wrist is oriented in a pivotal position near the ends of its ranges of unstressed or comfortable movement as indicated in FIGS. 4 and 5, substantial undesirable and unnecessary stress on the muscles and the tendons of the wrist, forearm and elbow may be generated. For example, following conventional techniques for using a straight-shafted racket, a forehand stroke of the locked-wrist type places substantial stress on the muscles and tendons of the wrist, forearm and elbow and this is especially so when the wrist is pivoted to maintain the racket in a "heads-up" orientation because the wrist is rotated or pivoted to a position near the upper limits of its possible unstressed or comfortable range of movement in the "q" direction of movement as indicated in FIG. 4. This is likewise true when utilizing a forehand stroke to return an oncoming ball at below waist level particularly when the holding angle is in the medium to high holding angle range, the high holding angle range being defined in the range from about 160° to about 180° (see FIG. 14). Conventional straight-shafted racket designs therefore promote stroking techniques that induce wrist, forearm and elbow strain and this is particularly true when torsional stress is added as is often occasioned by contacting and impacting the ball 16 on the racket stringing surface 14 outside of the area of the "sweet spot" 26. Such off center hits tend to further twist the wrist and forearm beyond the limits of comfortable endurance.

Figure 6:
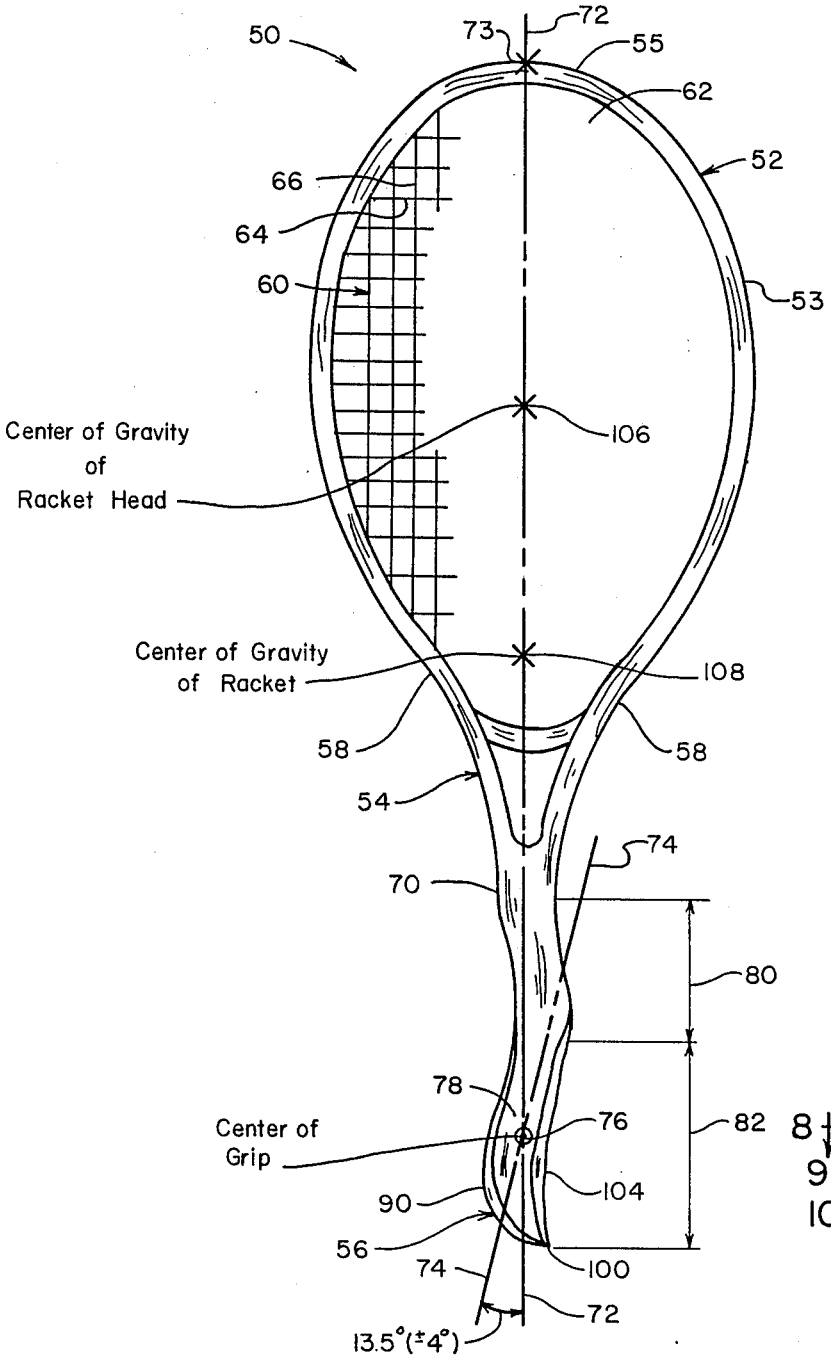
FIG. 6 is a front elevational view of a tennis racket constructed according to the teachings of the present invention.

FIG. 6 illustrates one embodiment 50 of a representative hand-held racket constructed according to the teachings of the present inventions. For illustration purposes only, all of the racket implements disclosed and discussed herein which embody the teachings of the present invention are directed to tennis rackets and the techniques for playing the game of tennis and, although the racket 50 is specifically designed for use in playing the game of tennis, it is recognized that the teachings of the present invention are adaptable for use in other hand-held rackets such as rackets used in playing the games of squash, racquetball, paddleball, ping pong and the like. It is also recognized that many of the techniques used in playing the game of tennis such as the types of grips and strokes employed during the course of play are likewise applicable to the techniques employed in the play of other hand-held racket type games. In the example illustrated in FIG. 6, the improved tennis racket 50 is preferably of a one-piece construction and includes a racket head assembly 52, a throat assembly 54, and a sloped or offset handle assembly 56 which is adapted to be grasped by the hand of a user in one of four basic positions to accommodate the different types of strokes and grips normally required in the usual play of a game of tennis.

Figure 7:
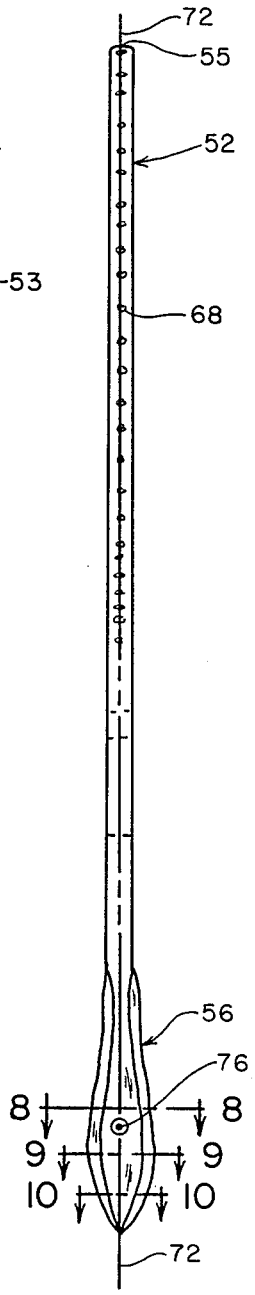
FIG. 7 is a side view of the tennis racket shown in FIG. 6.

More specifically, referring to FIGS. 6 and 7, the racket head assembly 52 comprises a generally oval racket head frame 53 which may be constructed of wood, metal, plastic, graphite or any other suitable material. The frame 53 includes an arcuate crown portion 55 at the upper end thereof and inwardly extending shoulder portions 58 at the lower portion thereof, the shoulders 58 merging with the racket throat assembly 54 at the lower end of the racket head frame 53. Conventional racket stringing 60 defines a generally planar playing surface or racket face 62 for striking a ball and includes horizontal and vertical string courses 64 and 66 strung through a series of openings 68 (FIG. 7) about the periphery of the racket frame 53 in a conventional manner. As best shown in FIG. 6, a straight-shafted racket portion 70 lies intermediate of and extends between the racket throat assembly 54 and the handle assembly 56. It is recognized that other racket head assembly shapes such as a tear-drop, elliptical, hexagonal or other polygonal shape may likewise be utilized as well as other stringing arrangements such as diagonal stringing. Also, the present racket 50 may be constructed without utilizing a throat assembly.

In the embodiment of FIG. 6, the axis 72 represents the axis of longitudinal equilibrium of the racket or implement 50, that is, the weight of the implement on one side of the axis 72 equals the weight of the implement on the opposite side. This means that if a static test is conducted on the racket 50 by suspending it between the two points 73 and 76 shown in FIG. 6 with the axis 72 maintained in a horizontal position, it is found that the racket 50 is in neutral equilibrium about the axis 72, that is, it is perfectly balanced. Also, if the racket 50 is suspended vertically from the point 73, a vertical axis through the point 73 will coincide with the axis 72 shown in FIG. 6. Additionally, in the racket 50, the equilibrium axis 72 also coincides with the longitudinal axis of the stringing surface or racket head 52 and extends downwardly through the central portion of the throat assembly 54 and the shaft portion 70 as shown in FIGS. 6 and 7, although these two axes need not necessarily coincide depending upon the shape and configuration of the various racket components such as the racket head assembly 52.

Of particular importance to the present invention is the sloped or offset racket handle 56. The racket handle assembly 56 includes a curved handle member 78 having a generally circular cross-sectional shape at the forward end portion 80 thereof which preferably integrally mates with or attaches to the racket shaft 70. The rear end portion or grip portion 82 of the handle member 78 smoothly merges with the forward end portion 80 and has dimensions that may be tailored to the hand size of a particular user, that is, it may be sized so that it will comfortably fit the grasp of a user having an average hand size, or it may be fashioned in a multitude of dimensions to accommodate a wide range of hand sizes. The core of the handle grip portion 82 may be constructed of conventional materials and may be covered with any conventional racket grip covering materials providing the desired anti-slip qualities such as leather stripping, a plastic or rubber material formed on the grip core or other like anti-slip type materials. The grip covering may likewise be slightly compressible to aid in maintaining the user's hand on the grip portion 82. The handle assembly 56 is specifically curved and contoured such that when attached to the lower end of the straight-shafted racket portion 70, the longitudinal axis 74 (FIG. 6) of the handle grip portion 82 intersects the axis of longitudinal equilibrium 72 at a point 76 on the handle 56 at an angle of about 13.5° (±4°) in the plane of the planar stringing surface or racket face 62 as shown in FIG. 6. Although the forward end portion 80 of the handle member 78 is shown in FIG. 6 to extend approximately half the overall length of the handle assembly 56, it is recognized that other proportionate lengths between the handle portions 80 and 82 may likewise be utilized so long as the longitudinal axis of the handle grip portion 82 forms an angle of about 13.5° (±4°) with the equilibrium axis 72 when attached to the racket shaft 70.

Figure 10:
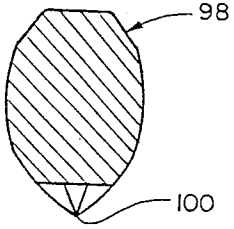
FIGS. 8, 9 and 10 are cross-sectional views of the racket handle assembly taken along the lines 8—8, 9—9 and 10—10 respectively of FIG. 7, the racket handle assembly being positioned in the upslope orientation.
Figure 9:
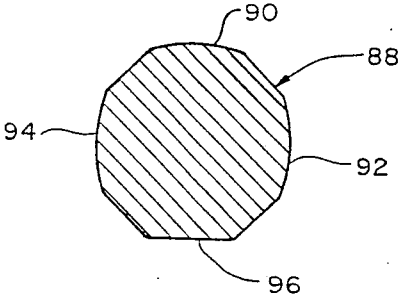
Figure 8:
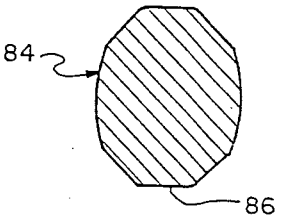

The handle grip 82 is of a variable generally octagonal cross-sectional shape as shown in FIGS. 8, 9 and 10. The forward section 84 of the grip 82 has a cross-sectional shape that is almost circular as shown in FIG. 8 so as to effect a smooth transition between the fore and aft portions 80 and 82 of the handle member 78, the bottom surface 86 being somewhat flattened as shown. The grip 82 further includes a middle section 88 having an octagonal cross-sectional shape as shown in FIG. 9 about which the hand of a user is adapted to be positioned in at least four different positions as will be hereinafter discussed. The middle grip section 88 is of an increased cross-sectional area relative to the forward grip section 84 and includes at least four segments thereof, these segments being a protruding upper, arcuate surface or bulbous portion 90, opposed protruding side arcuate surfaces or bulbous portions 92 and 94, and a flattened bottom surface 96 as shown in FIG. 9. These three arcuate or bulbous portions and the flattened portion 96 are specifically provided to accommodate the basic stroke types encountered during the course of play in all hand-held racket type games, namely, high and low forehand strokes and high and low backhand strokes. The rear section 98 of the grip 82 is of a reduced cross-sectional area relative to the forward and middle grip sections 84 and 88 respectively and tapers downwardly and rearwardly from the cross-sectional shape of the middle grip section 88 (FIG. 9) to the cross-sectional tear-drop shape shown in FIG. 10. The rear grip section 98 also includes a downwardly extending end tip portion 100 adapted to aid both in the grasping of the handle grip 82 and preventing one's hand from sliding off said handle grip during the course of play. The bulbous projections 90, 92 and 94 are also specifically designed and function so as to prevent a user's hand from slipping off the grip 82 during the course of play.

Figure 11:
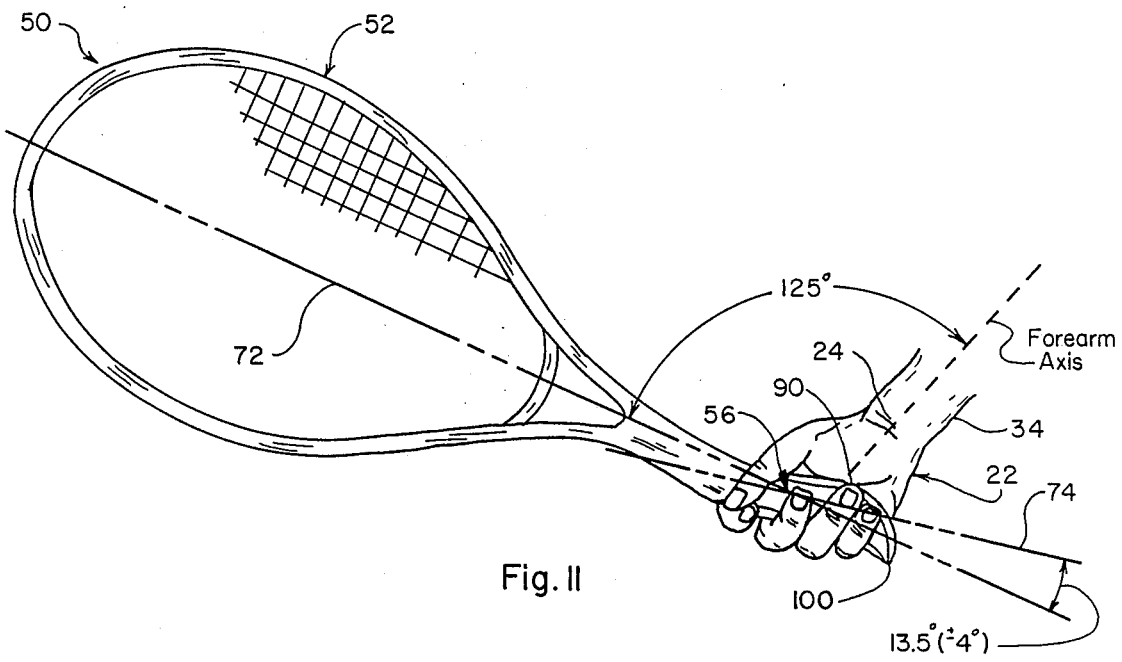
FIG. 11 is a plan view of the tennis racket of FIGS. 6 and 7 shown grasped by a user in the upslope position, the user's hand, wrist and forearm being shown in an appropriate position for executing a forehand stroke at waist level.
Figure 15:
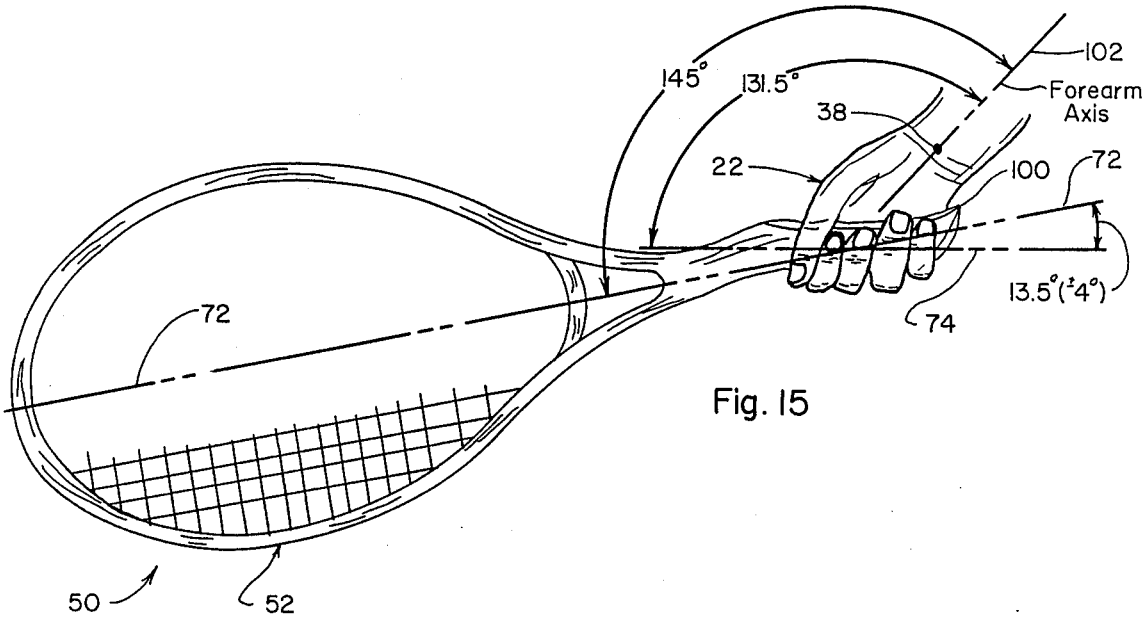
FIG. 15 is a plan view of the tennis racket of FIGS. 6 and 7 shown grapsed by a user in the downslope position, the user's hand, wrist and forearm being shown in an appropriate position for executing a forehand stroke at below waist level.
Figure 14:
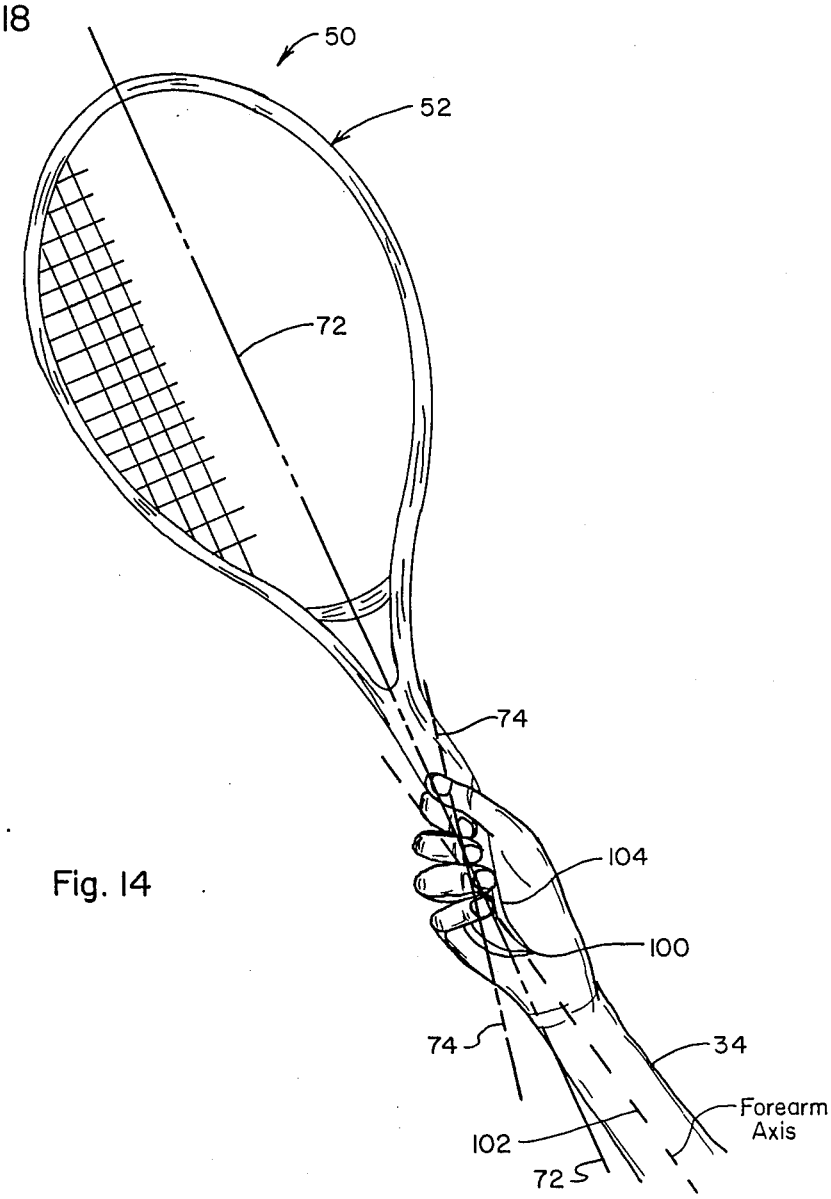
FIG. 14 is a plan view of the tennis racket of FIGS. 6 and 7 grasped by a user in the downslope position, the user's hand, wrist and forearm being shown in an appropriate position for executing a forehand stroke at shoulder level or higher.

The sloped or curved handle assembly 56 is designed to be grasped for play in one of two basic orientations, namely, an upslope orientation as shown in FIG. 11 or a downslope orientation as shown in FIGS. 14 and 15. The upslope orientation of the racket 50 (FIG. 11) is defined when the bulbous portion or mound 90 associated with the grip 82 is positioned skyward and the tip portion 100 points towards the playing surface. In contrast, the downslope orientation of the racket 50 (FIGS. 14 and 15) is defined when the bulbous portion or mound 90 associated with the grip 82 is positioned facing the playing surface and the tip portion 100 points skyward. Manipulation of the racket 50 during the course of play between the upslope and downslope orientations, which produces approximately a 30° change in racket head position in a plane parallel to the plane of the palm of the hand with no change in either wrist movement or grip angle, as well as the use of different grip styles in both racket orientations provides for better racket control and positioning and reduces the potential for injury to one's wrist, forearm and/or elbow as will be explained.

Figure 12:
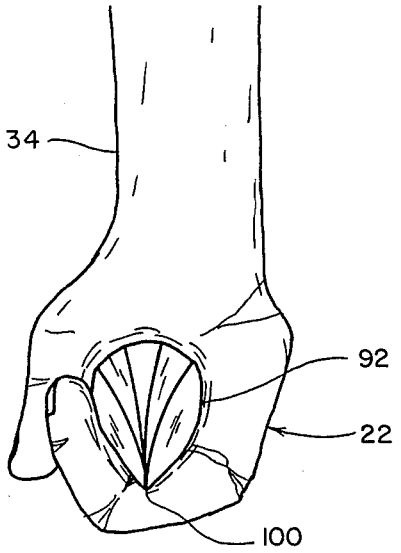
FIG. 12 is an end view of the butt end of the tennis racket shown in FIGS. 6 and 7 grasped in the upslope position for executing a forehand stroke.
Figure 13:
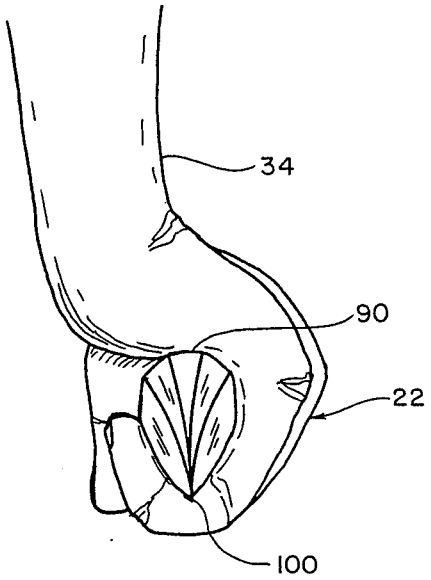
FIG. 13 is an end view of the butt end of the tennis racket shown in FIGS. 6 and 7 grasped in the upslope position for executing a backhand stroke.

For example, if utilizing a forehand stroke to hit an oncoming ball at waist level, a locked-wrist stroke is normally employed and, in this situation, the grip portion 82 of the racket handle 56 may be grasped in the upslope orientation as shown in FIGS. 11 and 12. It should be noted that the palm 42 (FIGS. 3 and 4) of the user's hand 22 is initially positioned as with a conventional Eastern grip to "shake hands" with the racket handle. However, with the present grip 82, the cavity of the palm is positioned slightly forward of the right hand bulbous portion 92 as shown in FIG. 12, the hand grasping the middle section 88 about the grip center or point 76 with the tip portion 100 pointing downwardly towards the playing surface. The point 76 represents the center of a user's grip when a user's hand is positioned around the grip 82 as shown in FIGS. 12 and 13. Because the longitudinal axis 74 of the grip portion 82 is at an angle of about 13.5° (±4°) to the equilibrium axis 72 of the racket 50, the grip 82 is in a generally horizontal position while the racket head 52 is elevated as shown in FIG. 11. For this reason, the racket head 52 may be oriented in a "heads-up" position (low holding angle) without pivoting or stressing the wrist of the user to achieve such racket head position as would be occasioned in use of a conventional straight-shafted racket wherein the wrist must be pivoted as shown in FIG. 4 to secure the same "heads-up" racket position. This means that the present handle assembly 56 automatically compensates for much of the pivotal movement of the wrist about its minor axis 38 when the racket 50 is held in the upslope orientation as shown in FIG. 11. Also, for this particular type of stroke, holding the racket 50 in the upslope orientation is more comfortable as compared to holding a conventional straight-shafted racket in the same "heads-up" racket position. Additionally, when using a conventional straight-shafted racket, additional wrist movement to obtain an even higher "heads-up" racket position further compounds the stress and strain on the wrist, forearm and/or elbow, all of which tends to further induce injury. The present handle assembly 56 provides for a more comfortable range of grasp and a more comfortable range of wrist movement and enables a user to achieve the desired racket position, in this case the "heads-up" racket position, without overloading or overstressing the wrist and/or elbow. The grip 82 is specifically designed to be grasped in a comfortable manner over the entire range of grasping the handle assembly 56 and likewise facilitates and enhances the rapid grip adjustments made during the course of play.

If utilizing a backhand stroke to hit an oncoming ball at, for example, waist level, a user's wrist may be rotated approximately 45° from the forehand position shown in FIG. 12 to the position shown in FIG. 13 so that the hand 22 is about the grip center or point 76 and the cavity of the palm 42 receives the upper bulbous portion 90 as shown in FIG. 13. In such a position, the planar surface of the racket head 52 is maintained in a vertical position relative to the playing surface upon contact with the oncoming ball. The design and location of the bulbous portions 90 and 92 make it a relatively easy task for the user to quickly and easily manipulate the racket 50 and adjust from the grip position shown in FIG. 12 for executing a particular forehand stroke to the grip position shown in FIG. 13 for executing a particular backhand stroke because the bulbous portions 90 and 92 are easily identifiable by feel alone. This facilitates use of the proper grip for the particular stroke desired. As discussed with the execution of the forehand stroke depicted in FIG. 11, execution of a backhand stroke while maintaining the racket head 52 in the same holding angle range as compared when using a conventional straight-shafted tennis racket for executing a similar type shot can be accomplished as explained above without pivoting or stressing the wrist of the user to achieve such racket head position. Regardless of whether one is attempting to execute a forehand or a backhand stroke, the present handle assembly 56 facilitates rapid grip adjustments and compensates for much of the pivotal movement of the wrist necessary to maintain a proper "heads-up" racket position and a proper holding angle depending upon the location of the oncoming ball.

The present handle assembly 56 also importantly compensates for much of the pivotal movement of the wrist needed to properly execute either a forehand or a backhand stroke at shoulder level or above employing excessive wrist snap. For such a snap-wrist stroke, the racket handle 56 is re-oriented as shown in FIG. 14 wherein the grip 82 is rotated approximately 180° from the position utilized for a forehand stroke at approximately waist level shown in FIG. 11. To execute the shoulder level or higher forehand stroke, the left hand bulbous portion 94 of the middle grip section 88 is positioned adjacent the cavity of the palm 42 and the palm is pressed thereagainst about the grip center or point 76. In this orientation, it should be noted that the racket 50 is grasped in what has been defined as the downslope position wherein the bulbous portion or mound 90 of the grip 82 is directed towards the playing surface and the grip tip portion 100 is pointing generally upwardly or skyward. In the downslope racket orientation shown in FIG. 14, it should also be noted that the longitudinal axis of the forearm 102 is nearly aligned with the implement equilibrium axis 72. This position is particularly advantageous because in strokes at shoulder level and higher, including service strokes, the snap-wrist stroke is often employed and for such snap-wrist action, as shown in FIG. 5, it is important that the forearm axis 102 and the implement equilibrium axis 72 be as nearly aligned as possible if undue torsional and other stress is to be avoided on the muscles and tendons of the wrist, forearm and elbow. This is not true if the racket 50 is held in an upslope orientation for a shoulder level or higher forehand stroke because for such a stroke, the forearm and implement equilibrium axes 102 and 72 respectively cannot be easily comfortably maintained in near alignment with each other without overpivoting or overstressing the wrist about its minor axis 38. Also, for this particular type of stroke, holding the racket 50 in the downslope orientation is more comfortable as compared to the upslope orientation because the palm of the hand wraps around and mates with the concave portion 104 of the grip 82. Gripping the racket 50 in the downslope orientation for this particular type of stroke also facilitates generation of maximum power when hitting the ball and enhances racket head control for all of the reasons discussed above, a feature not as easily accomplished when using a conventional straight-shafted racket.

Grasping the handle assembly 56 in the downslope orientation is also advantageous for use in executing both forehand and backhand strokes when attempting to hit an oncoming ball at a relatively low position such as at below waist level as shown in FIG. 15. In this situation, the downslope orientation of the racket 50 automatically positions the racket head 52 in a "heads-down" position (medium to high holding angle) (FIG. 15) because of the approximate 13.5° (±4°) angular displacement between the implement equilibrium axis 72 and the longitudinal axis 74 of the handle grip 82. This racket orientation also automatically compensates for much of the pivotal movement of the wrist about its minor axis 38 for all of the reasons already discussed since the downslope orientation automatically orients the racket head 52 in the proper "heads-down" position and in the proper holding angle range without pivoting or stressing the wrist of the user to achieve such racket head position. In this regard, it should be noted that although the holding angle depicted in FIG. 15 is approxiately 145°, the grip angle, that is, the angle between the forearm axis 102 and the longitudinal axis of racket handle 74, is only approximately 131°. This is not true when using a conventional straight-shafted racket since, in that case, the wrist must be pivoted as illustrated in FIG. 4 to acheive the same "heads-down" position and both the holding angle and the grip angle are the same, for example, 145°. Also, when using a conventional straight-shafted racket, additional wrist movement to obtain an even lower "heads-down" racket position (greater holding angle) further compounds the stress and strain on the wrist, forearm, and/or elbow.

The present handle assembly 56 also facilitates greater use of a "heads-neutral" or substantially horizontal swing for both close-in body strokes and full arm extension strokes. The "heads-neutral" swing is considered optimum for either generating maximum power when used in association with a full arm extension stroke or for achieving maximum accuracy and placement of the ball when used in association with a close-in body stroke. The "heads-neutral" swing can be accomplished by gripping the handle assembly 56 in either the upslope or downslope orientation depending upon whether the upcoming shot will be a close-in body shot or a full arm extension shot. Execution of a "heads-neutral" swing of the close-in body type is perhaps best accomplished by holding the racket 50 in an upslope orientation (FIG. 16) whereas execution of a "heads-neutral" swing of the full arm extension type is perhaps best accomplished by holding the racket 50 in a downslope orientation (not shown).

Figure 16:
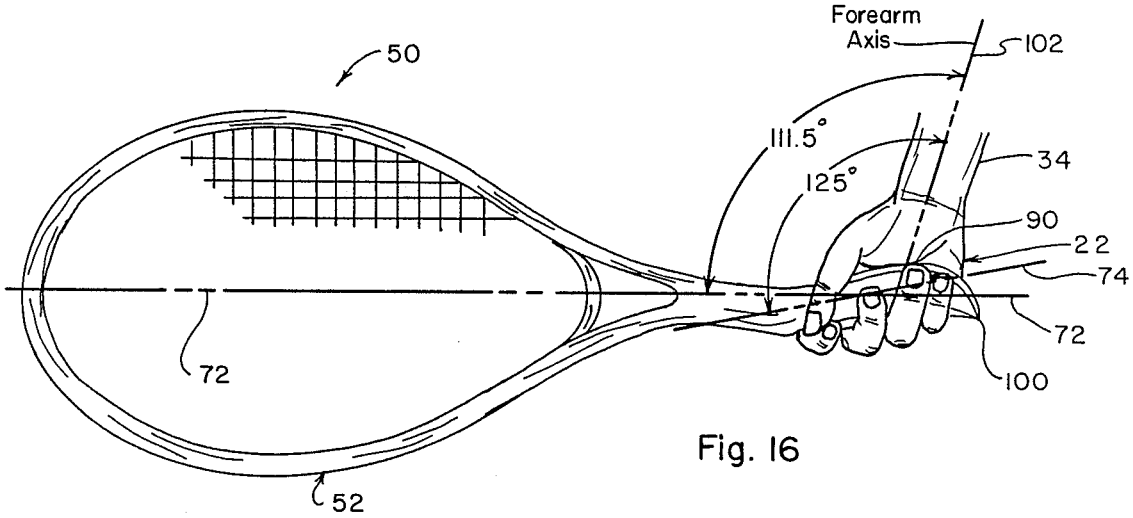
FIG. 16 is a plan view of the tennis racket of FIGS. 6 and 7 shown grasped by a user in the upslope position, the user's hand, wrist and forearm being shown in an appropriate position for executing a forehand stroke at waist level to maintain a "heads-neutral" racket position.

Referring to FIG. 16, it can be seen that the "heads-neutral" racket position for a close-in body shot can be easily achieved by gripping the racket handle 56 in the upslope orientation as previously explained. More importantly, it should be noted that the same grip angle (approximately 125°) previously required when using a conventional straight-shafted racket to maintain a "heads-up" racket position as illustrated in FIG. 2 produces a "heads-neutral" racket position when the present racket 50 is held in its upslope orientation as shown in FIG. 16. In contrast, when holding the racket 50 in a downslope orientation for executing a "heads-neutral" full arm extension stroke (not shown), although the holding angle required for achieving this particular "heads-neutral" position may be the same as that required for maintaining a conventional straight-shafted racket in a similar "heads-neutral" position, the grip angle associated with gripping the present handle assembly 56 will be reduced by the 13.5° (±4°) angular displacement between the equilibrium axis of the racket and the grip portion of the handle assembly. As previously explained, this reduces both the overall pivotal movement of the wrist and the potential for injury. The present racket 50 is therefore designed to facilitate greater and easier use of this more desirable and advantageous swing over a greater range of shots while using a more comfortable grasp and while minimizing stress and strain to one's wrist, arm and elbow.

The basic advantage in using the offset or sloped handle assembly 56 of the present invention is that the handle 56 allows a user to quickly and rapidly make all the necessary adjustments in racket head position, holding angle, and grip by simply making changes in the way the handle 56 is grasped, that is, gripping the handle 56 in either the upslope or the downslope position or any variations thereof. Simply changing one's grasp from an upslope racket orientation to a downslope racket orientation produces approximately a 30° change in racket head position with no change in wrist movement about the minor axis 38 of the wrist. This is not true when using a conventional straight-shafted racket wherein changes in grasp as well as changes in wrist movement are required to achieve the same racket head position. It is this need to use considerably more wrist movement during the course of play, particularly in the game of tennis, which increases the potential for wrist, arm, and/or elbow injury when using a conventional straight-shafted racket design.

In addition, regardless of whether the handle 56 is grasped in an upslope or a downslope position, the majority of the support of the handle assembly 56 in one's hand rests upon the lower pad 106 of the thumb (FIGS. 3 and 4). When the handle 56 is grasped in the upslope position the lower pad 106 of the thumb rests upon the mound 90 of the grip 82 and when grasped in the downslope position the lower thumb pad 106 rests in the concave portion 104 of the grip 82. Both the mound 90 and the concave portion 104 of the grip 82 are specifically designed to fit a user's hand at the lower thumb pad 106 as explained so that the hand does not have the tendency to move fore and aft along the length of the handle. This provides for a more comfortable grasp of the handle 56.

The present handle assembly 56 also fosters and enhances rapid changes between the different styles of grips used for executing different types of strokes such as changes from an Eastern grip to a Western or Continental grip. Because of its shape and contour, the present handle 56 more specifically facilitates and enhances use of both the Eastern and Continental grips and enables proper use of each. For example, service strokes are perhaps best accomplished holding the racket 50 in a downslope orientation using a Western grip and full arm extension strokes at chest level are perhaps best accomplished holding the racket 50 in the downslope orientation using a Continental grip. Use of these various grip styles in combination with the upslope/downslope orientation of the present racket enables a user to enjoy a more comfortable range of holding angles/gripping angles as compared to those available when using a conventional straight-shafted implement.

For utilizing the racket 50 according to the present invention for a chest level or higher backhand stroke, the racket handle 56 is rotated approximately 45° to 90° from the forehand grip position shown in FIG. 14 such that the flattened bottom portion 96 is received in the cavity of the palm 42 of the user's hand. This re-orientation likewise permits maintenance of a vertical racket face at the point of impact of an oncoming ball when executing a backhand stroke at chest level or higher. When grasping the racket 50 in the downslope position, it is the design and location of the bulbous portion 94 and the flattened bottom portion 96 of the grip 82 which facilitates the quick and easy manipulation of the racket 50 from a more comfortable and unstressed forehand grip position to a more comfortable and unstressed backhand grip position and, because of their shape and contour, this manipulation can be properly accomplished by feel alone.

Ideally, for a perfectly balanced implement, it is preferred that the center of gravity 106 of the racket head 52, the center of gravity 108 of the entire implement 50 and the grip center 76 all lie on the axis of longitudinal equilibrium 72, although some deviation from the equilibrium axis 72 in the range of ±3° is also acceptable. However, it is important that at least the grip center 76 and the center of gravity 106 of the racket head substantially coincide with the equilibrium axis 72 so as to both provide a substantially balanced implement and improve the sense of feel in a user's hand. This arrangement also produces an implement which allows a user to achieve greater racket control and positioning and a more comfortable range of wrist, forearm and elbow movement while reducing the potential for injury.

Figure 17:
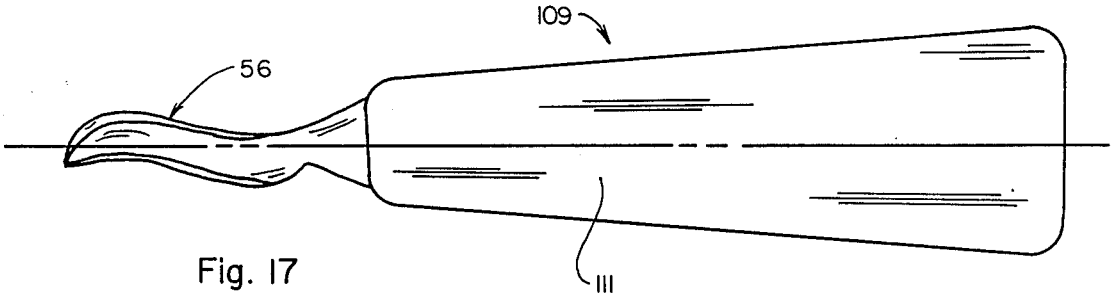
FIG. 17 is a front elevational view of a tennis blade or paddlebat constructed utilizing the racket handle of the present invention shown in FIGS. 6–16.
Figure 18:
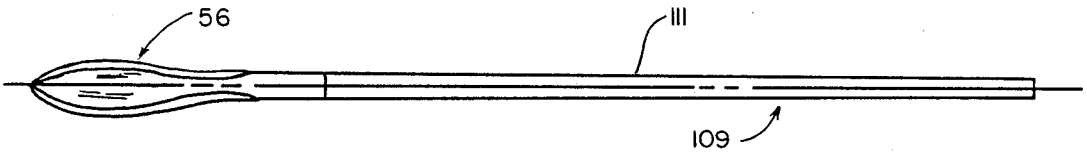
FIG. 18 is a side view of the implement shown in FIG. 17.

FIGS. 17 and 18 disclose use of the present handle assembly 56 on a tennis blade or paddlebat 109 which includes a generally flat planar hitting surface 111 of uniform material composition for striking a ball. The implement 109 is primarily used for tennis training purposes although it is anticipated that other uses are likewise possible. FIGS. 17 and 18 are illustrative of the fact that the present handle assembly 56 can be adapted to any hand-held implement.

Figure 19:
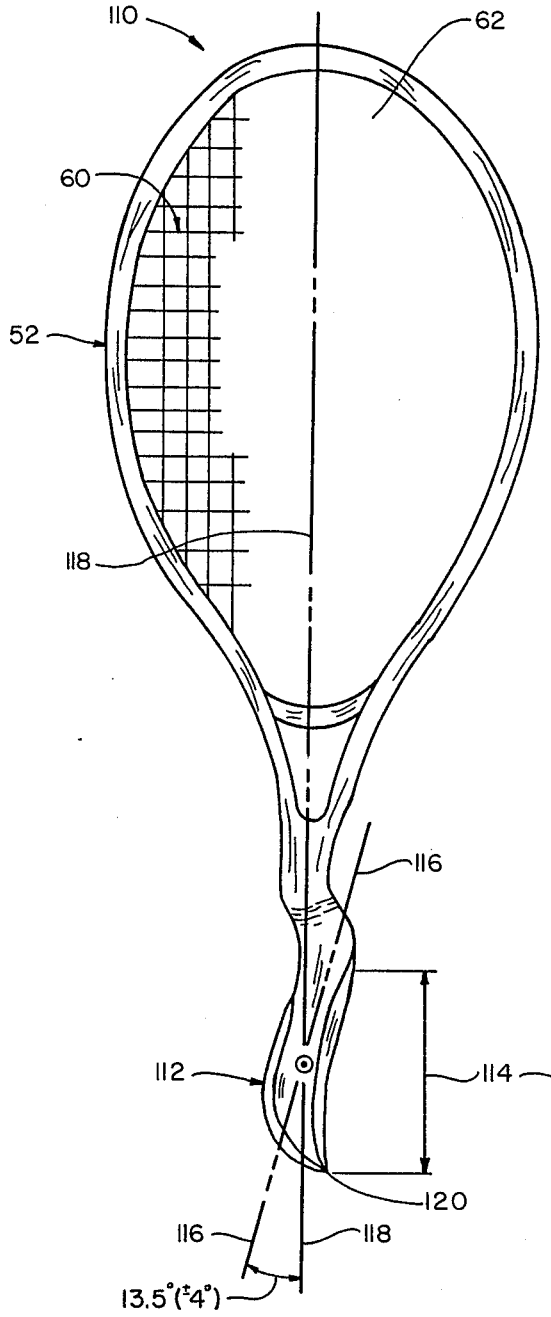
FIG. 19 is a front elevational view of an alternate embodiment of the tennis racket of FIGS. 6 and 7 constructed according to the teachings of the present invention, the racket handle being constructed specifically for a right-handed user.
Figure 20:
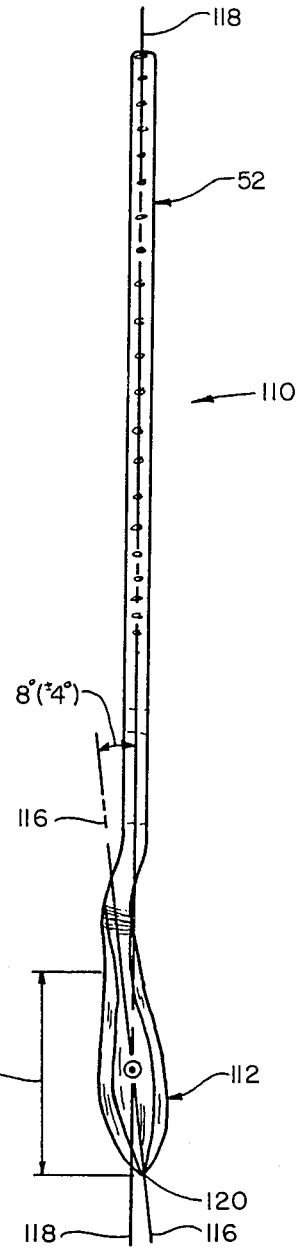
FIG. 20 is a left side view of the tennis racket shown in FIG. 19.

FIGS. 19 and 20 disclose an alternate embodiment 110 of the present racket 50, the tennis racket 110 being constructed and designed substantially identical to the racket 50 (FIGS. 6 and 7) except that the racket 110 includes a handle assembly 112 having an additional handle offset provided in still another plane as compared to the handle assembly 56. The handle 112 includes a grip portion 114 having a longitudinal axis 116 that is not only offset in the plane of the racket face 62 by an angle of about 13.5° (±4°) to the axis of longitudinal equilibrium 118 of the racket 110 (FIG. 19), but it is also offset with respect to the equilibrium axis 118 in a plane perpendicular to the plane of the racket face 62 by an angle of about 8° (±4°) as best shown in FIG. 20. It has been found that this additional angular offset in the plane perpendicular to the plane of the racket face 62 as shown in FIG. 20 is advantageous in further avoiding or relieving the wrist, forearm and elbow stresses heretofore described in detail. Besides compensating for all of the problems previously discussed with respect to the racket 50, the additional 8° (±4°) angular offset associated with the handle 112 also helps one to avoid leading forehand slots with the elbow and punching backhand shots as well as problems with speed of return, accuracy and power since this additional offset induces one's wrist to lead the shot in both the upslope and downslope positions. For example, in using the racket 110 for executing a relatively low or waist level forehand stroke, the racket handle grip 114 is grasped so that the handle end tip 120 points downwardly and the racket handle 112 leads the racket head 52 in the direction of the stroke. The handle construction 112 results in a position of the user's wrist with respect to the racket head 52 that may only be achieved with a conventional straight-shafted racket by a stroke utilizing a laid-back wrist position as heretofore discussed. However, by utilizing the handle assembly 112 of the racket 110, such a laid-back wrist action can be achieved without overloading or overstressing the wrist. This additional 8° (±4°) angular offset also further facilitates the transition from one grip or racket orientation to another and further facilitates use of the various grip styles during the course of play.

In addition, it is also important to note that this additional angular offset in the plane perpendicular to the plane of the racket face 62 necessitates differently configured handle assemblies for right and left handed players. In this regard, the handle 112 depicted in FIGS. 19 and 20 is specifically designed for use by a right-handed player and the view illustrated in FIG. 20 represents a left side view of the implement 110 shown in FIG. 19. When so viewed as illustated in FIG. 20, the 8° (±4°) angular offset will project to the left of the implement equilibrium axis 118 for right-handed players and such offset will project to the right of the implement equilibrium axis 118 (not shown) for left-handed players. It should also be noted that construction of the handle assembly 112 for a left-handed player would be a mirror image of the handle 112 shown in FIG. 20. Furthermore, it should also be understood that the various techniques employed in using the racket 110 (FIGS. 19 and 20) including grasping the racket 110 in either the upslope or downslope position depending upon the location, speed and type of spin associated with the oncoming ball and/or gripping the handle assembly 112 in any one of the different styles of grips are, in all respects, identical to the techniques hereinbefore discussed with respect to the racket 50 shown in FIG. 6.

Thus, there has been shown and described several embodiments of an improved hand-held racket for tennis and the like that fulfills all of the objects and advantages sought therefor. It will be understood by one skilled in the art that while the inventive racket improvements disclosed herein have been described for use in the game of tennis, the concepts and structures associated with the present invention are likewise applicable to the games of squash, racquetball, paddleball, ping pong and other hand-held racket type games. Many changes, modifications, variations and other uses and applications of the present constructions and concepts will, however, become apparent to those skilled in the art after considering this specification and the accompanying drawings, and all such changes, modifications, variations and other uses and applications which do not depart from the spirit and scope of the invention are deemed to be covered by the invention which is limited only by the claims which follow.

What is claimed is:

1. An improved implement for use in playing the game of tennis and the like, said implement having an axis of longitudinal equilibrium and including a head assembly having a generally planar surface for striking a ball, a handle assembly operatively connected to said head assembly, said handle assembly including a grip portion adaptable to be grasped by the hand of a user, said grip portion having a longitudinal axis which intersects the axis of longitudinal equilibrium of said implement at an angle of approximately 9.5 to 17.5 degrees in the plane of the planar surface of said head assembly, said head assembly having a longitudinal axis which coincides with the axis of longitudinal equilibrium of said implement.

2. The implement defined in claim 1 wherein said grip portion includes a central grip point defined as the grip center about which a user's hand is positioned when grasping said grip portion.

3. The implement defined in claim 2 wherein said grip center coincides with the intersection of the equilibrium axis of said implement and the longitudinal axis of said grip portion.

4. The implement defined in claim 2 wherein the center of gravity of said head assembly and the grip center lie substantially on the axis of longitudinal equilibrium of said implement.

5. The implement defined in claim 2 wherein the center of gravity of said head assembly, the center of gravity of said implement, and the grip center lie substantially on the axis of longitudinal equilibrium of said implement.

6. The implement defined in claim 1 wherein the grip portion of said handle assembly includes three bulbous projections about the periphery thereof about which a user's hand is adapted to be positioned, said bulbous projections being circumferentially spaced about said periphery at approximately 90 degree intervals.

7. The implement defined in claim 6 wherein the grip portion of said handle assembly includes a substantially flat surface on one side thereof, said substantially flat surface being circumferentially located about the periphery of said grip portion substantially opposite one of said bulbous portions, said substantially flat surface being located on the bottom portion of said grip portion when the planar surface of said head assembly is oriented in a generally vertical plane.

8. The implement defined in claim 1 wherein said handle assembly is operatively connected to said implement head so that the longitudinal axis of said grip portion also intersects the axis of longitudinal equilibrium of said implement at an angle of approximately 4 to 12 degrees in a plane perpendicular to the plane of the planar surface of said head assembly.

9. A hand-held racket for use in playing the game of tennis and the like, said racket having an axis of longitudinal equilibrium and comprising a racket head and a handle assembly operatively connected thereto, said racket head including a generally planar stringing surface adaptable for striking a ball, said handle assembly including a grip portion adaptable to be grasped by the hand of a user, said grip portion including at least three bulbous projections about the periphery thereof about which a user's hand is adapted to be positioned, said bulbous projections being circumferentially spaced about said periphery at approximately 90 degree intervals, said grip portion having opposite ends and including a central point defined as the grip center located intermediate said opposite ends about which a user's hand is positioned when grasping said grip portion, said grip portion having a longitudinal axis which intersects the axis of longitudinal equilibrium of said racket at an angle of approximately 9.5 to 17.5 degrees in the plane of the stringing surface of said racket head, said grip center coinciding with the intersection of the longitudinal axis of said grip portion and the equilibrium axis of said racket, the center of gravity of said racket head lying substantially on the axis of longitudinal equilibrium of said racket.

10. The racket defined in claim 9 wherein the center of gravity of said racket and the center of gravity of said racket head lie substantially on the axis of longitudinal equilibrium of said racket.

11. The racket defined in claim 9 wherein the grip portion of said handle assembly is of a variable cross-sectional shape.

12. In a racket for use in playing the game of tennis and the like, said racket having an axis of longitudinal equilibrium and including a racket head, a throat portion located adjacent said racket head at one end portion thereof, a racket handle operatively connected to said throat portion and adaptable to be grasped by the hand of a user, said racket head including a generally planar surface for striking a ball, the improvement comprising said racket handle including three bulbous surface portions protruding outwardly about the periphery thereof, said three bulbous portions being spaced at approximately 90 degree intervals about said periphery, a non-bulbous surface portion connecting two of said bulbous portions and being positioned opposite said third bulbous portion, each of said bulbous portions and said non-bulbous portion being adaptable to be positioned in four different locations in a user's hand to accommodate different racket strokes encountered during the course of play, said racket handle including a grip portion havng a longitudinal axis which intersects the axis of longitudinal equilibrium of said racket at an angle of approximately 9.5 to 17.5 degrees in the plane of said racket head.

13. The improvement defined in claim 12 wherein the center of gravity of said racket and the center of gravity of said racket head lie substantially on the equilibrium axis of said racket.

14. An improved implement for use in playing the game of tennis and the like, said implement having an axis of longitudinal equilibrium and including a head assembly having a generally planar surface for striking a ball, a handle assembly operatively connected to said head assembly and including a grip portion adaptable to be grasped by the hand of a user, said grip portion having a longitudinal axis which intersects the axis of longitudinal equilibrium of said implement at a point spaced from said head assembly at an angle of approximately 9.5 to 17.5 degrees in the plane of said head assembly and which also intersects said equilibrium axis at a point spaced from said head assembly at an angle of approximately 4 to 12 degrees in a plane perpendicular to the plane of said head assembly, said grip portion including a central grip point defined as the grip center about which a user's hand is positioned when grasping said grip portion, the center of gravity of said head assembly and said grip center lying substantially on the axis of longitudinal equilibrium of said implement.

15. The implement defined in claim 16 wherein said grip center coincides with the intersection of the equilibrium axis of said implement and the longitudinal axis of said grip portion.

16. The implement defined in claim 14 wherein the grip portion of said handle assembly includes three bulbous projections about the periphery thereof about which a user's hand is adapted to be positioned, said bulbous projections being circumferentially spaced about said periphery at approximately 90 degree intervals.

17. The implement defined in claim 16 wherein the grip portion of said handle assembly includes a substantially flat surface on one side thereof, said substantially flat surface being circumferentially located about the periphery of said grip portion substantially opposite one of said bulbous portions, said substantially flat surface being located on the bottom portion of said grip portion when the planar surface of said head assembly is oriented in a generally vertical plane.

18. The implement defined in claim 16 wherein the center of gravity of said head assembly, the center of gravity of said implement, and the grip center lie substantially on the axis of longitudinal equilibrium of said implement.

19. An improved implement for use in playing the game of tennis and the like, said implement having an axis of longitudinal equilibrium and including a head assembly having a generally planar surface for striking a ball, a handle assembly operatively connected to said head assembly, said handle assembly including a grip portion adaptable to be grasped by the hand of a user, said grip portion having a longitudinal axis which intersects the axis of longitudinal equilibrium of said implement at an angle of approximately 9.5 to 17.5 degrees in the plane of the planar surface of said head assembly, said grip portion including a central grip point defined as the grip center about which a user's hand is positioned when grasping said grip portion, the center of gravity of said head assembly and said grip center lying substantially on the axis of longitudinal equilibrium of said implement.

20. An improved implement for use in playing the game of tennis and the like, said implement having an axis of longitudinal equilibrium and including a head assembly having a generally planar surface for striking a ball, a handle assembly operatively connected to said head assembly, said handle assembly including a grip portion adaptable to be grasped by the hand of a user, said grip portion having a longitudinal axis which intersects the axis of longitudinal equilibrium of said implement at an angle of approximately 9.5 to 17.5 degrees in the plane of the planar surface of said head assembly, said grip portion including a central grip point defined as the grip center about which a user's hand is positioned when grasping said grip portion, the center of gravity of said head assembly, the center of gravity of said implement, and said grip center lying substantially on the axis of longitudinal equilibrium of said implement.

21. The hand-held racket for use in playing the game of tennis and the like, said racket having an axis of longitudinal equilibrium and comprising a racket head and a handle assembly operatively connected thereto, said racket head including a generally planar stringing surface adaptable for striking a ball, said handle assembly including a grip portion adaptable to be grasped by the hand of a user, said grip portion including at least three bulbous projections about the periphery thereof about which a user's hand is adapted to be positioned, said bulbous projections being circumferentially spaced about said periphery at approximately 90 degree intervals, said grip portion including a central point defined as the grip center about which a user's hand is positioned when grasping said grip portion, said grip portion having a longitudinal axis which intersects the axis of longitudinal equilibrium of said racket at an angle of approximately 9.5 to 17.5 degrees in the plane of the stringing surface of said racket head, said grip center coinciding with the intersection of the longitudinal axis of said grip portion and the equilibrium axis of said racket, the center of gravity of said racket head lying substantially on the axis of longitudinal equilibrium of said racket.

22. A hand-held racket for use in playing the game of tennis and the like, said racket having an axis of longitudinal equilibrium and comprising a racket head and a handle assembly operatively connected thereto, said racket head including a generally planar stringing surface adaptable for striking a ball, said handle assembly including a grip portion adaptable to be grasped by the hand of a user, said grip portion including at least three bulbous projections about the periphery thereof about which a user's hand is adapted to be positioned, said bulbous projections being circumferentially spaced about said periphery at approximately 90 degree intervals, said grip portion including a central point defined as the grip center about which a user's hand is positioned when grasping said grip portion, said grip portion having a longitudinal axis which intersects the axis of longitudinal equilibrium of said racket at an angle of approximately 9.5 to 17.5 degrees in the plane of the stringing surface of said racket head, said grap center coinciding with the intersection of the longitudinal axis of said grip portion and the equilibrium axis of said racket, the center of gravity of said racket and the center of gravity of said racket head lying substantially on the axis of longitudinal equilibrium of said racket.

23. In a racket for use in playing the game of tennis and the like, said racket having an axis of longitudinal equilibrium and including a racket head, a throat portion located adjacent said racket head at one end potion thereof, a racket handle operatively connected to said throat portion and adaptable to be grasped by the hand of a user, said racket head including a generally planar surface for striking a ball, the improvement comprising said racket handle including three bulbous projections about the periphery thereof, said bulbous projections being spaced at approximately 90 degrees intervals about said periphery, a substantially flat surface connecting two of said bulbous projections and being positioned opposite said third bulbous projection, each of said bulbous projections and said flat surface being adaptable to be positioned in four different locations in a user's hand to accommodate different racket strokes encountered during the course of play, said racket handle including a grip portion having a longitudinal axis which intersects the axis of longitudinal equilibrium of said racket at an angle of approximately 9.5 to 17.5 degrees in the plane of said racket head, the center of gravity of said racket and the center of gravity of said racket head lying substantially on the equilibrium axis of said racket.

24. An improved implement for use in playing the game of tennis and the like, said implement having an axis of longitudinal equilibrium and including a head assembly having a generally planar surface for striking a ball, a handle assembly operatively connected to said head assembly and including a grip portion adaptable to be grasped by the hand of a user, said grip portion having a longitudinal axis which intersects the axis of longitudinal equilibrium of said implement at an angle of approximately 9.5 to 17.5 degrees in the plane of said head assembly and also intersects said equilibrium axis at an angle of approximately 4 to 12 degrees in a plane perpendicular to the plane of said head assembly, said grip portion including a central grip point defined as the grip center about which a user's hand is positioned when grasping said grip portion, the center of gravity of said head assembly and said grip center lying substantially on the axis of longitudinal equilibrium of said implement.

25. An improved implement for use in playing the game of tennis and the like, said implement having an axis of longitudinal equilibrium and including a head assembly having a generally planar surface for striking a ball, a handle assembly operatively connected to said head assembly and including a grip portion adaptable to be grasped by the hand of a user, said grip portion having a longitudinal axis which intersects the axis of longitudinal equilibrium of said implement at an angle of approximately 9.5 to 17.5 degrees in the plane of said head assembly and also intersects said equilibrium axis at an angle of approximately 4 to 12 degrees in a plane perpendicular to the plane of said head assembly, said grip portion including a central grip point defined as the grip center about which a user's hand is positioned when grasping said grip portion, the center of gravity of said head assembly, the center of gravity of said implement, and said grip center lying substantially on the axis of longitudinal equilibrium of said implement.

* * * * *

UNITED STATES PATENT OFFICE

CERTIFICATE OF CORRECTION

Patent No. 4,759,546 Dated July 26, 1988

Inventor(s) John R. Steele, Jr.

It is certified that error appears in the above-identified patent and that said Letters Patent are hereby corrected as shown below:

In the Abstract, column 2, line 5, "or" should be --of--.

Column 20, line 42, "degrees" should be --degree--.

Signed and Sealed this

Twentieth Day of December, 1988

*Attest:*

DONALD J. QUIGG

*Attesting Officer*

*Commissioner of Patents and Trademarks*